United States Patent [19]

Goodrich

[11] Patent Number: 4,615,624

[45] Date of Patent: Oct. 7, 1986

[54] TRAIL MONITOR

[76] Inventor: George W. Goodrich, 5123 N. Kellen Ct., Bloomfield Hills, Mich. 48013

[21] Appl. No.: 761,002

[22] Filed: Jul. 31, 1985

[51] Int. Cl.[4] ..... G04F 8/00; G04B 47/00

[52] U.S. Cl. ..... 368/1; 368/10; 368/113

[58] Field of Search ..... 368/1, 3, 9, 10, 101, 368/110, 112, 113

[56] References Cited

U.S. PATENT DOCUMENTS 2,619,170 11/1952 Rath ..... 368/1

*Primary Examiner*—Vit W. Miska

[57] ABSTRACT

A suspended-line-and-clock trail monitor improved (1) by anchoring the monitor-end of the trip-line in such a manner that when a crossing animal increases line tension beyond a predetermined threshold, stored line pays out to and is carried by the animal, thereby recording its precise path and direction of travel across a line of almost any length and (2) by introducing a resettable, lightly triggered actuator between the line and the clock thereby providing reliable operation from a mass-produced, low-cost, general-purpose digital clock in place of the usual stop watch, even with a line of light sewing thread. Such thread cost effectively combines sufficient line length for long runs with good portability.

6 Claims, 3 Drawing Figures

TRAIL MONITOR

BACKGROUND

1. Field of Invention

The invention concerns apparatus for remotely monitoring movements of large animals.

2. Prior Art

It is known art to suspend a thread above the ground so that the next animal passing reveals its presence by breaking the thread. It is also known art to anchor one end of a trip string to the start button of a stop watch thereby recording the time of day of passage.

However, these techniques do not record the path of travel across a long course since the line breaks where it is weakest rather than at the point of crossing. Often the broken ends recoil leaving the direction of travel uncertain as well. In addition stop watches are costly due to the limited volume of manufacture.

BRIEF SUMMARY OF THE INVENTION

As just outlined the invention employs a suspended line and a clock. However, one end of the suspended line is anchored in a special way. Following initial placement this anchor is locked, withstanding at least enough tension to hold the line taut. However, once the tension in the line exceeds a predetermined threshold, as when an animal crosses, the anchor yeilds or better still changes from this first, locked state to a second, free state wherein on demand of tension the line pays out freely from a spool on which it is stored, causing the animal to carry the line some distance before it finally steps clear or the line snags and breaks. In either event the carried line records the precise path and direction of travel. This capability, combined with screweye guides to periodicly support a long line, extends the coverage of one unit many times over.

Ways of implementing the two-state anchor include (1) mounting a spool of line on a vertically swinging arm so hinged at its base that it has an over-vertical, elevated position of stable equilibrium wherein the axis of the spool is nearly vertical (locked state) and a lower position of stable equilibrium after falling on its side wherein the axis of the spool is nearly horizontal and the line pays off the end of the spool (free state) and (2) having the thread trigger release a cocked-spring actuator that in turn releases a brake preventing the spool from turning.

In place of the line activating the usual specialized stop watch, the invention prefers sewing thread and a standard clock. Tension in the thread above a predetermined level needed to hold the thread taut trips a separately provided, resettable actuator that in turn activates the control element of an everyday clock, the term control element referring to a latch, switch or the like that can start or stop the clock. In this way a general-purpose, digital clock of commerce, mass produced in great quantity at low cost, can replace the specialized stop watch. For example, the clock trade offers several general-purpose, digital clocks termed "stick-on" clocks that are widely available at low cost. They are stopped, started, and set by proper sequential manipulation of two control switches made for hand activation. Requirements of the resettable actuator are that it respond if and only if the tension in the thread attached to it exceeds a predetermined threshold level needed to maintain tautness. Upon responding it must deliver a suitable output stroke to the control element of the clock of sufficient energy to actuate the clock. The advantage of thread over heavier line is that it allows the device to be compact and portable yet capable of recording long carries. Accordingly the resettable actuator should be able to respond to a weak input force, well under the breaking strength of thread, and deliver an energetic output stroke, the control switches of inexpensive digital clocks often requiring substantial finger pressure for activation.

Methods of implementing the resettable actuator include (1) a hinged arm falling from an over-vertical, elevated position of stable equilibrium to a lower position of stable equilibrium and (2) a trigger-released, cocked-spring actuator. By taking advantage of the commonality between either of these methods and the analagous method of implementing the two-state anchor, some of the component parts can serve dual roles leading to partiularly high performance and cost effective embodiments of the invention.

Other aspects of the invention, covered in the detailed description only, concern refinements making the hardware especially easy to carry, set up and dismantle.

Accordingly it is an object of the invention to provide a suspened-line-and-clock trail monitor for recording the precise path, direction and time of travel of large animals. Another objective is to provide a suspended-line-and-clock trail monitor utilizing a general-purpose, digital clock of commerce. Another objective of the invention is to accomplish the above objectives in a reliable, convenient to use and cost effective package.

DESCRIPTION OF THE PREFERRED EMBODIMENT

Figure 1:
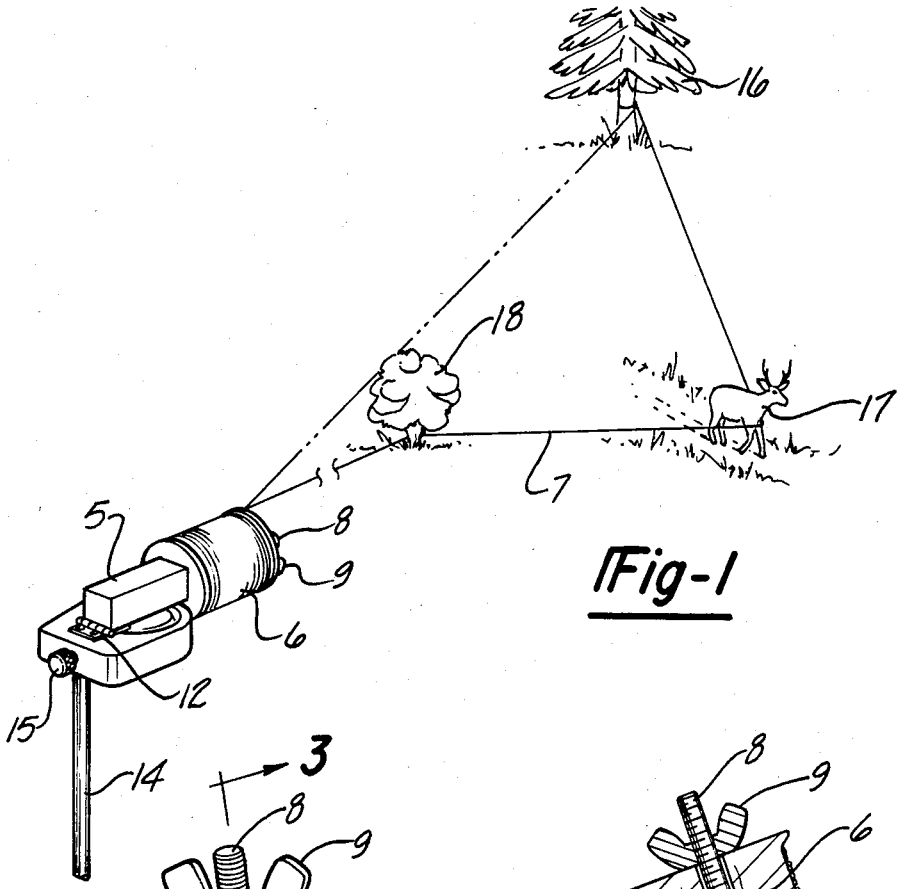
FIG. 1 is a panoramic view of a preferred embodiment of the of the invention based upon a falling arm. The unit is recording a crossing.

Referring to FIG. 1 the trail monitor is shown in its second, free state. Here suspended thread 7 anchored to tree 16 or the like at one end pays off from horizontally oriented spool 6 mounted on vertically swinging arm 5, shown stopped in its lower position of stable equilibrium at the limit of its downswing, as thread 7 is carried forward by moving animal 17. Vertically swinging arm 5 is pivotally attached to support member 1 by hinge 12 attached thereto by screws 13. Shortly thread 7 will snag on bush 18 and break or perhaps animal 17 will step clear of thread 7. In either case a trail of paid-off thread records the path and direction of travel. During set-up one end of shaft 14, typically an arrow shaft easily carried in an archer's quiver, is inserted upright in the ground.

Figure 2:
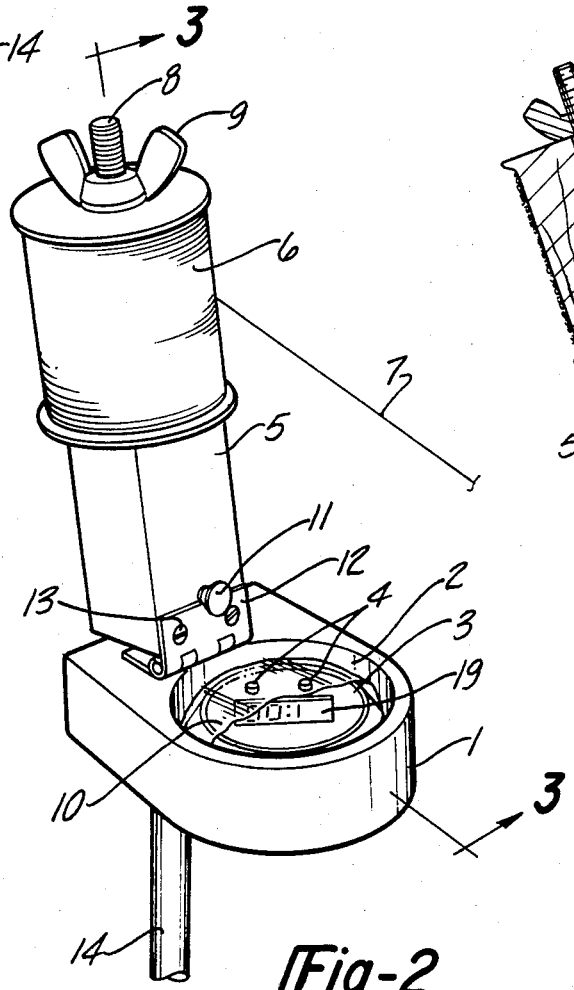
FIG. 2 is a perspective view of the embodiment of FIG. 1 after reset, hence prepared for recording another crossing.
Figure 3:
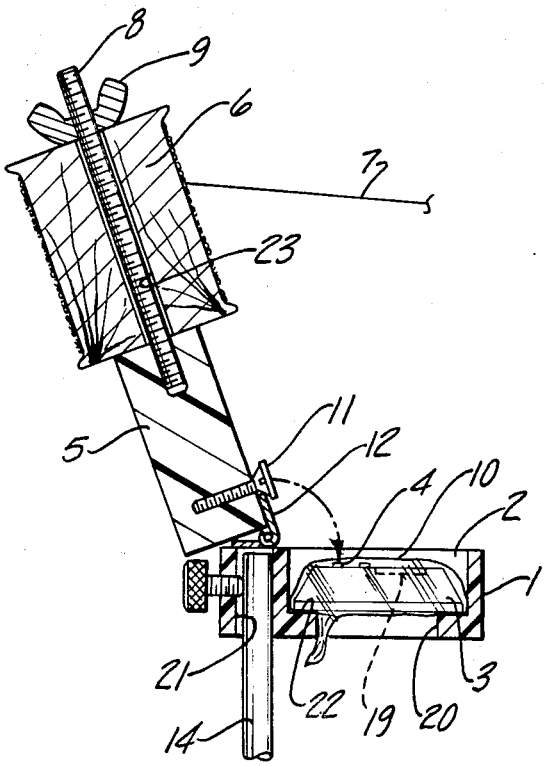
FIG. 3 is a sectional view along line 3—3 of FIG. 2.

Referring to FIGS. 2 and 3, support member 1 is held upside oriented up on the free end of shaft 14 inserted in hole 21 in support member 1 and clamped there by finger bolt 15. The monitor is oriented so that arm 5 in its lowered position is directed along the intended course of thread 7. Next thread 7 is pulled out along the intended course and anchored at its end distant from the monitor. Then arm 5 is raised against the stop delimiting its upswing in an over-vertical, elevated position of stable equilibrium, as shown. Then finger nut 9 on spindle stud 8 set in arm 5 is loosened allowing spool 6, having hole 23 provided therein along the axis of winding of thread about spool 6 for receiving stud 8, to be rotated to take up excess slack. Then finger nut 9 is tightened, thereby clamping spool 6 to arm 5 and placing the trail monitor in the first, resettable, elevated, locked state.

Electrically powered digital clock of commerce 3 having control switches 4 is detachably held on support member 1 in retention well 2 having bottom lip 22 and bottom opening 20 formed therein. Wrapper 10 of transparent plastic film protects clock 3 against rain, dew and dust, any free ends of wrapper 10 extending downward around lip 22 and through opening 20 to shed water away from clock 3. Clock 3 is set to zero and stopped by proper sequential operation of control switchs 4 (alternatively set to current time and left running). Clock 3 is placed so screw 11 threaded into arm 5 delivers an output stroke that actuates the proper control switch 4 to start clock 3 running (alternatively stop clock 3) when sufficient tension arises in thread 7 to trigger arm 5 to fall from the first, resettable, elevated, locked state to the second, lower, free state. Subtraction of elapsed time, read from display 19, from current time (alternatively indicated time read from display 19) gives the time of day and date of passage.

Since the position of control switch 4 in the direction of action varies from one clock design to another and from one clock to another of one design, the versatility and reliability of the trail monitor are enhanced by incorporating preselectable adjustment means, such as provided by screw 11, for delimiting the extreme advance of the of the portion of swinging arm 5 that delivers the output stroke to control switch (or more generaly element) 4.

If the clock chosen does not require the added sensitivity and directionality of the above resettable actuator, a good way to still provide the pay-line-on-demand capability is to rotatablely mount spool 6 of line 7 on a spindle attached to support member 1. A portion of free line near spool 6 is then attached directly to the control element 4 of clock 3, for example between the fingers of a small spring clip affixed to element 4. Tension on line 7 first activates element 4. Thereafter line 7 pulls free from the clip and pays off spool 6 to animal 17.

Since many changes and variations of the invention may be made without departing from the inventive concept, it is not intended to limit the invention otherwise than as required by the appended claims.

What is claimed is:

1. A suspended-line-and-clock trail monitor wherein the improvement comprises:

a clock having actuatable control means;

a support member for holding said clock thereon;

a holding spool attached to said support member;

a continuous line wound on said holding spool, said continuous line having a free portion thereof unwound from said holding spool and a remainder portion remaining wound on said holding spool, said free portion being attachable at its end nearest said holding spool to said actuatable control means; and line dispensing means for controlling dispensation of line from said remainder portion to said free portion of said continuous line upon demand of any tension in said free portion of said continuous line in excess of a predetermined threshold.

2. The suspended-line-and-clock trail monitor of claim 1 further comprising:

a shaft for upright insertion in the ground with the free end of said shaft projecting thereabove; and demountable attachment means for demountably attaching said support member to said free end of said shaft.

3. The suspended-line-and-clock trail monitor of claim 1 wherein said line dispensing means acting on said continuous line for controlling dispensation of line from said remainder portion to said free portion of said continuous line has a first, resettable, locked state whereby the lengths of said free portion and said remainder portion of said continuous line are fixed and a second, free state, induced from said first, locked state upon occurance of any tension in said free portion of said continuous line in excess of a predetermined threshold, wherein said continuous thread passes freely from said remainder portion to said free portion upon continuing occurance of any tension in said free portion of said continuous line.

4. The suspended-line-and-clock trail monitor of claim 3 wherein:

said support member has an upside and has holding means for holding said support member with said upside oriented up;

said holding spool has an axis of winding of said continuous line about said holding spool; and said actuatable control means of said clock further comprises:

said clock having an actuatable control element;

a vertically swinging arm attached to said support member by a pivot, said vertically swinging arm having an upswing and a downswing;

first stop means acting between said vertically swinging arm and said support member for delimiting said upswing to a first, over-vertical, elevated, position of stable equilibrium;

said holding spool attached to said vertically swinging arm whereby said axis of winding is substantially vertical in said first, over-vertical, elevated position of stable equilibrium;

second stop means acting between said vertically swinging arm and said support member for delimiting said downswing to a second, lower position of stable equilibrium whereby said axis of winding is substantially horizontal; and a portion of said vertically swinging arm being disposed to deliver said output stroke on said actuatable control element of said clock.

5. The suspended-line-and-clock trail monitor of claim 4 wherein said portion of said verticaly swinging arm disposed to deliver said output stroke to said control element of said clock has a direction of action and an extreme advance of said stroke in said direction of action and preselectable adjustment means for delimiting said extreme advance in said direction of action.

6. A suspended-line-and-clock trail monitor wherein the improvement comprises:

a digital clock having an actuatable control switch;

a support member for holding said digital clock thereon;

resettable actuator means disposed on said support member, said resettable actuator means means having an input member for receiving an input force thereon and an output member for delivering an output stroke therefrom, said output member being disposed to deliver said output stroke on said actuatable control switch of said digital clock, said resettable actuator means relating said output stroke to said input force whereby upon reset no output stroke is delivered until said input force exceeds a predetermined threshold and once said input force exceeds said predetermined threshold said output force is delivered with sufficient energy to actuate said actuatable control switch of said digital clock; and a suspended line having one end attached to said input member whereby said input member receives any tension in said suspended line as said input force.

* * * * *